US006825827B2

(12) United States Patent
Miura

(10) Patent No.: US 6,825,827 B2
(45) Date of Patent: Nov. 30, 2004

(54) INFORMATION PROCESSING APPARATUS

(75) Inventor: Hirotsuna Miura, Fujimi-machi (JP)

(73) Assignee: Seiko Epson Corporation (JP)

( * ) Notice: Subject to any disclaimer, the term of this patent is extended or adjusted under 35 U.S.C. 154(b) by 297 days.

(21) Appl. No.: 10/197,632

(22) Filed: Jul. 16, 2002

(65) Prior Publication Data

US 2003/0011587 A1 Jan. 16, 2003

(30) Foreign Application Priority Data

Jul. 16, 2001 (JP) ..... 2001-215608

(51) Int. Cl.[7] ..... G09G 3/36
(52) U.S. Cl. ..... 345/98; 345/204; 345/211
(58) Field of Search ..... 345/87, 98, 204, 345/211; 455/566, 574; 713/310

(56) References Cited

U.S. PATENT DOCUMENTS 5,784,037 A * 7/1998 Inoue ..... 345/87
6,597,351 B2 * 7/2003 Saunamaki et al. ..... 345/204
2002/0015016 A1 * 2/2002 Kudo et al. ..... 345/87
2002/0052220 A1 * 5/2002 Tsukada et al. ..... 455/566

* cited by examiner

*Primary Examiner*—Regina Liang
(74) *Attorney, Agent, or Firm*—Harness, Dickey & Pierce, P.L.C.

(57) ABSTRACT

A mobile telephone 10 in accordance with the present invention includes a BBE unit 21 with a host CPU 11 as a core, an application unit 26 with an application processor (a high-speed operation processing apparatus such as a DSP) as a core, and an interface (I/F) 25 that manages exchange of data between the BBE unit 21 and the application unit 26. On an OS 26*a* of the application unit 26 is provided a command interface management resident software 26*b* for performing a buffer management, command management, interrupt process of the like.

10 Claims, 7 Drawing Sheets

INFORMATION PROCESSING APPARATUS

BACKGROUND OF THE INVENTION

Technical Filed of the Invention

The present invention relates to information processing apparatuses, and more particularly to information processing apparatuses that display characters and images on a display device such as a liquid crystal display device and an organic material type display device.

Conventional Technology

Conventionally, in an information processing apparatus such as a mobile telephone or a mobile information terminal (PDA: Personal Digital Assistants) that is equipped with a display device such as a liquid crystal display device, an organic material type display device or the like, when characters and images are displayed on the display device, an operation processing device within the information processing apparatus (which corresponds, for example, to a host CPU in the mobile telephone and a main processor in the PDA) directly sends data to a display engine (which corresponds, for example, to a liquid crystal driver IC in the case of the display device being a liquid crystal display device) that drives the display device.

FIG. 6 shows a mobile telephone 50 that includes a host CPU 51, a display engine 52 and a liquid crystal display 53. The display engine 52 is composed of a driver IC for driving liquid crystal 54. The host CPU 51 and the driver IC for driving liquid crystal 53 are connected to each other by a host interface 55. The host interface 55 includes a chip select signal line, a read signal line, a write signal line, a data signal line, an interrupt signal line and the like.

The conventional mobile telephone 50 shown in FIG. 6 is limited to displaying characters and still pictures, and cannot execute personal information management software (PIM: Personal Information Management) or handle moving pictures. For this reason, the third generation mobile telephones that have been under development in recent years and digital cameras use a high-speed signal processing apparatus such as a DSP (Digital Signal Processors) or the like for their display engine in order to accommodate great data rates for transferring moving pictures and enable execution of PIM.

FIG. 7 shows a part of a structure of the third generation mobile telephone. In FIG. 7, the third generation mobile telephone 60 includes a host CPU 61, a display engine 62 and a liquid crystal display device 63. The display engine 62 is composed of a high-speed signal processing apparatus 64 such as a DSP and a driver IC for driving liquid crystal 65. The host CPU 61 and the high-speed signal processing apparatus 64 are connected to each other by a high-speed bus interface 66. The high-speed bus interface 66 includes a chip select signal line, a read signal line, a write signal line, a data signal line, an interrupt signal line and the like. Also, the high-speed signal processing apparatus 64 and the driver IC for driving liquid crystal 65 are connected to each other by a liquid crystal controller interface 67. The liquid crystal controller interface 67 includes a display data line for transferring display data that have been signal-processed.

However, for the third generation mobile telephone 60, substantial modifications are required over the host controller interface 55 as viewed from the host CPU 51 toward the display engine 52 of the conventional mobile telephone 50 shown in FIG. 6 to achieve the high-speed bus interface 66 as viewed from the host CPU 61 toward the display engine 62.

Also, in the third generation mobile telephone 60 shown in FIG. 7, the high-speed signal processing apparatus 64 needs to operate always without regard to whether it is in telephone conversation or in use of the PIM function, which results in a greater power consumption.

Furthermore, although the third generation mobile telephone 60 shown in FIG. 7 is equipped with the host CPU 61 and the high-speed signal processing apparatus 64, the OS and application are mounted right on the host CPU of the BBE(base band engine), which makes the role sharing by the two devices difficult. Also, when the specifications of hardware and software are changed, the entire system has to be modified.

The present invention has been made in view of the problems discussed above, and its object is to provide an information processing apparatus that can add high level functions while taking over the conventional host interface, by transferring commands from a CPU to a high-speed signal processing device such as a DSP or the like when moving pictures are received or a PIM is executed, and transferring instructions from the CPU to a driver IC for driving liquid crystal or the like when reception of moving pictures is completed or execution of a PIM is completed.

Also, it is an object to provide an information processing apparatus that can reduce the overall power consumption of the information processing apparatus, when reception of moving pictures or execution of a PIM is not conducted, by placing the high-speed signal processing device in a low power consumption state.

Furthermore, it is an object to provide an information processing apparatus that can display field intensity, time and the like on a liquid crystal display device or the like, by directly sending instructions from a CPU to a driver IC for driving liquid crystal or the like, while maintaining the high-speed signal processing device in a low power consumption state in cases other than reception of moving pictures or execution of a PIM.

Also, it is an object to provide an information processing apparatus that can control a high-speed signal processing device from a CPU.

Furthermore, it is an object to provide an information processing apparatus that can efficiently manage sharing of the roles of a CPU for a BBE and a CPU for an application.

SUMMARY OF THE INVENTION

To solve the problems described above, an information processing apparatus in accordance with the present invention is characterized in comprising: a display device that displays characters or images; a display driving device that has the display device display characters or images based on an instruction; an information processing section that receives a command, processes the command, and sends an instruction to the display driving device; a CPU that sends out the command addressed to the information processing section when a process by the information processing section is necessary, and sends out an instruction addressed to the display driving device in other cases; a control device that transfers, upon receiving the command addressed to the information processing section, the command to the information processing section, and transfers, upon receiving the instruction addressed to the display driving device, the instruction to the display driving device; and an interface device that receives the command or the instruction from the CPU and transfers the same to the display driving device or the control device, wherein the information processing section is equipped with an application for reproducing moving pictures and a resident software that exchanges data with the application and manages interrupt and buffer processing of the command, the CPU is equipped with a BBE (base band engine), and the control device bidirectionally exchanges the command between the resident software and the BBE.

Here, the information processing section is capable of taking an operation state or a low power consumption state, and capable of shifting to the low power consumption state when a command that indicates shifting to the low power consumption state is received or when a command that indicates shifting to the low power consumption state is not received for a specified period of time.

Furthermore, the information processing apparatus may be a mobile telephone or a mobile information terminal (PDA).

By transferring commands from the CPU to the information processing section, upon receiving moving pictures or executing a PIM, and transferring instructions from the CPU to the display driving device upon completion of reception of moving pictures or completion of execution of the PIM, high level functions can be added while taking over the conventional host interface. Also, by placing the information processing section in a low power consumption state when reception of moving pictures or execution of the PIM is not performed, the overall power consumption of the information processing apparatus can be reduced. Furthermore, since instructions can be directly sent from the CPU to the display driving device, the field intensity, time and the like can be displayed on the display device while maintaining the information processing section in a low power consumption state in cases other than reception of moving pictures or execution of the PIM. Also, the information processing section can be controlled from the CPU.

Also, by exchanging commands between the BBE and the resident software, an interface can be achieved between two modules. Also, by integrating interfaces into one, the modulability can be improved, such that, when the BBE or the application is modified, mutual influences inflicted on them can be restrained to the minimum. Also, when the functions are expanded, such a situation can be readily accommodated by adding commands. Furthermore, by using the resident software, high level operations that are well accommodated by the application can be performed.

DETAILED DESCRIPTION OF THE PREFERRED EMBODIMENTS OF THE PRESENT INVENTION

Embodiments of the present invention will be described with reference to the accompanying drawings. It is noted that the same components will be indicated by the same reference numbers, and their description will not be duplicated.

Figure 1:
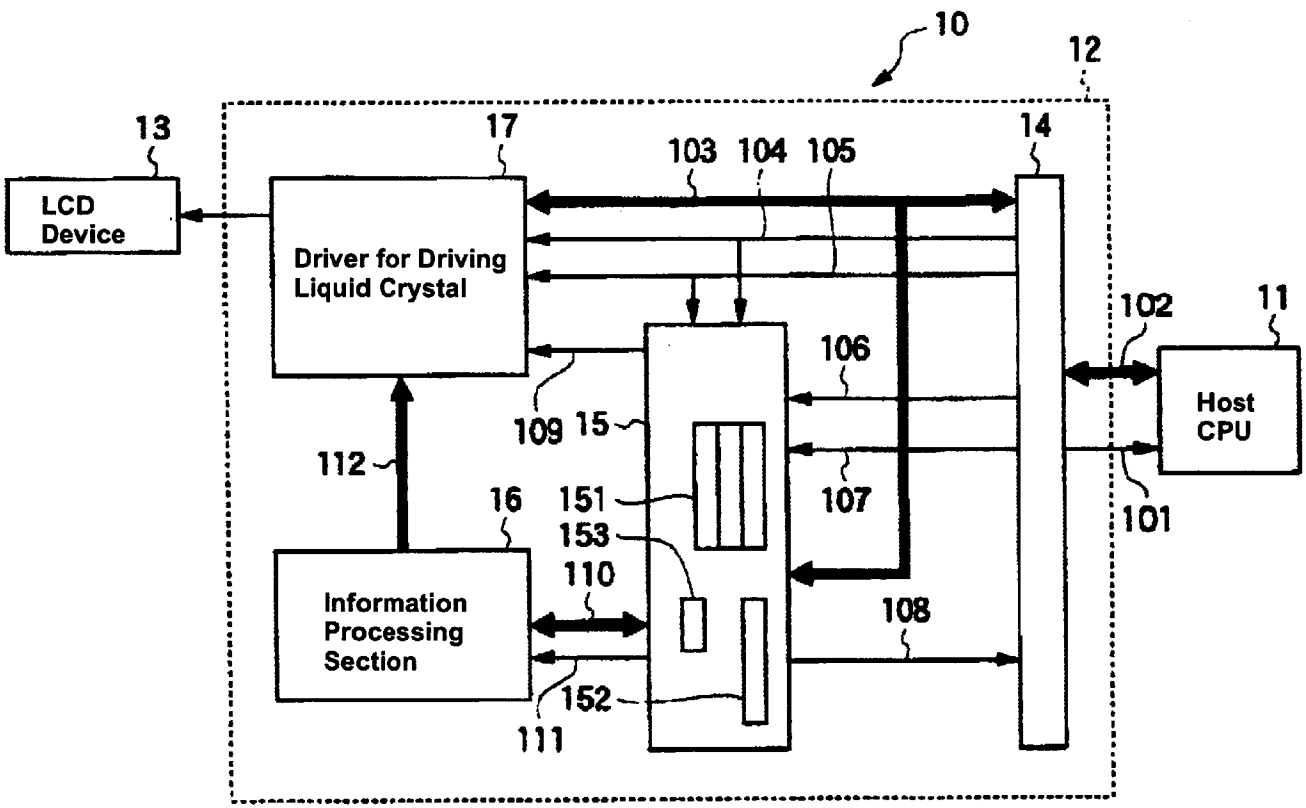
FIG. 1 schematically shows a data processing apparatus in accordance with one embodiment of the present invention.

FIG. 1 schematically shows a structure in part of a mobile telephone in accordance with an embodiment of the present invention.

As shown in FIG. 1, a mobile telephone in accordance with the present embodiment includes a host CPU 11, a display engine 12 and a liquid crystal display 13. Also, the display engine 12 is equipped with a host interface 14, a command interrupt logical circuit 15, an information processing section 16 and a driver for driving liquid crystal 17.

The host CPU 11 performs an overall control of the mobile telephone 10. The host CPU 11 transfers to the host interface 14 an interface switching command for switching between a state in which commands are directly sent to the driver for driving liquid crystal 17 and a state in which the information processing section 16 instructs the driver for driving liquid crystal 17, a standby command for shifting the information processing section 16 into a standby state, a suspend command for shifting the information processing section 16 into a suspend state, a time-up date command for rewriting time information in the information processing section 16, a communication command for receiving and transferring telephone numbers or the like, and a key input data receiving command.

The command interrupt logical circuit 15 monitors commands and data that are sent from the host CPU 11 through the host interface 14 to a command and data line 103, and controls the information processing section 16 and the driver for driving liquid crystal 17 based on the commands and data. The command interrupt logical circuit 15 is equipped with a buffer 153 for exchanging data, a group of a predetermined number of registers 151 that retain commands and data accompanying the commands, and a status resistor 152 that indicates a state of the command interrupt logical circuit 15.

The information processing section 16 is a high-speed operation processing apparatus such as a DSP, which receives commands and data from the host CPU 11 when the mobile telephone 10 receives moving pictures or executes a PIM, and sends instructions to the driver for driving liquid crystal 17 based on the commands and data. The information processing section 16 shifts to a standby state upon receiving a standby command from the host CPU 11 or a time-out. Also, the information processing section 16 shifts to a standby state upon receiving a suspend command from the host CPU 11 or a time-out in the standby state. The information processing section 16 can reduce the power consumption to a low level in the standby state or in the suspend state.

The driver for driving liquid crystal 17 is a driver IC or the like that displays characters, pictures and the like on the liquid crystal display device 13.

The host CPU 11 and the host interface 14 are connected to each other by a command and data line 102 and an interrupt request line 101.

The host interface 14, the command interrupt logical circuit 15, and the driver for driving liquid crystal 17 are mutually connected by the command and data line 103.

The host interface 14 and the driver for driving liquid crystal 17 are connected to each other by a read signal line 104 and a write signal line 105.

The host interface 14 and the command interrupt logical circuit 15 are connected to each other by a chip select signal line 106, a signal line 107 and an interrupt request line 108.

The command interrupt logical circuit 15 and the driver for driving liquid crystal 17 are connected to each other by a chip select signal line 109.

The command interrupt logical circuit 15 and the information processing section 16 are connected to each other by a command and data line 110 and an interrupt request line 111.

The information processing section 16 and the driver for driving liquid crystal 17 are connected to each other by a liquid crystal controller interface 112.

Figure 2:
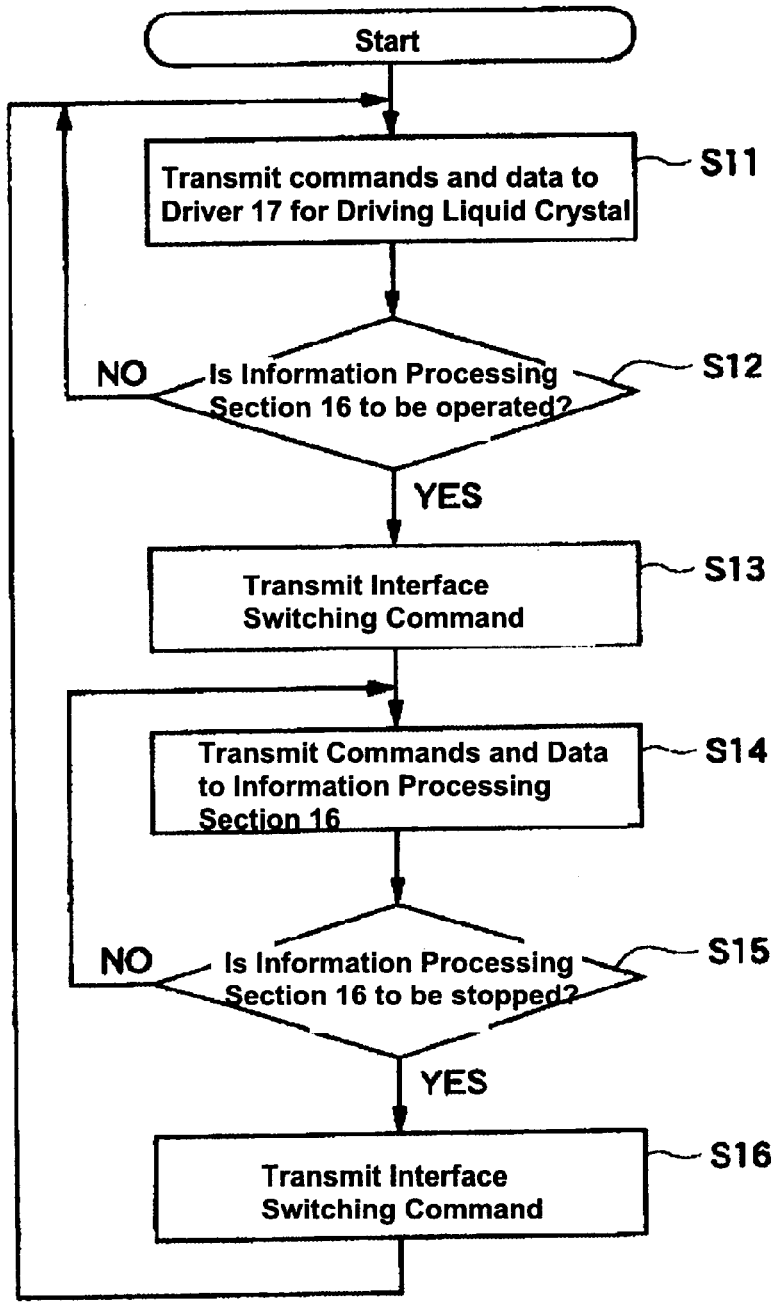
FIG. 2 shows a flow chart illustrating a process performed by a host CPU in FIG. 1.
Figure 3:
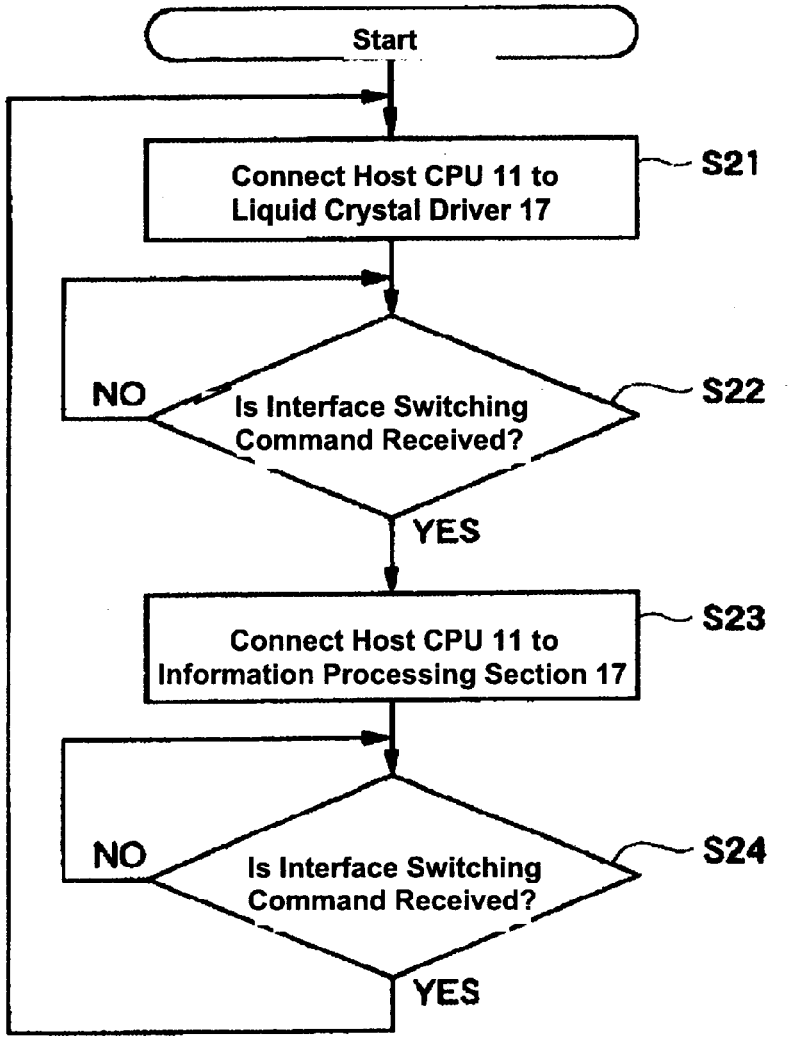
FIG. 3 shows a flow chart illustrating a process performed by a command interrupt logical circuit in FIG. 1
Figure 4:
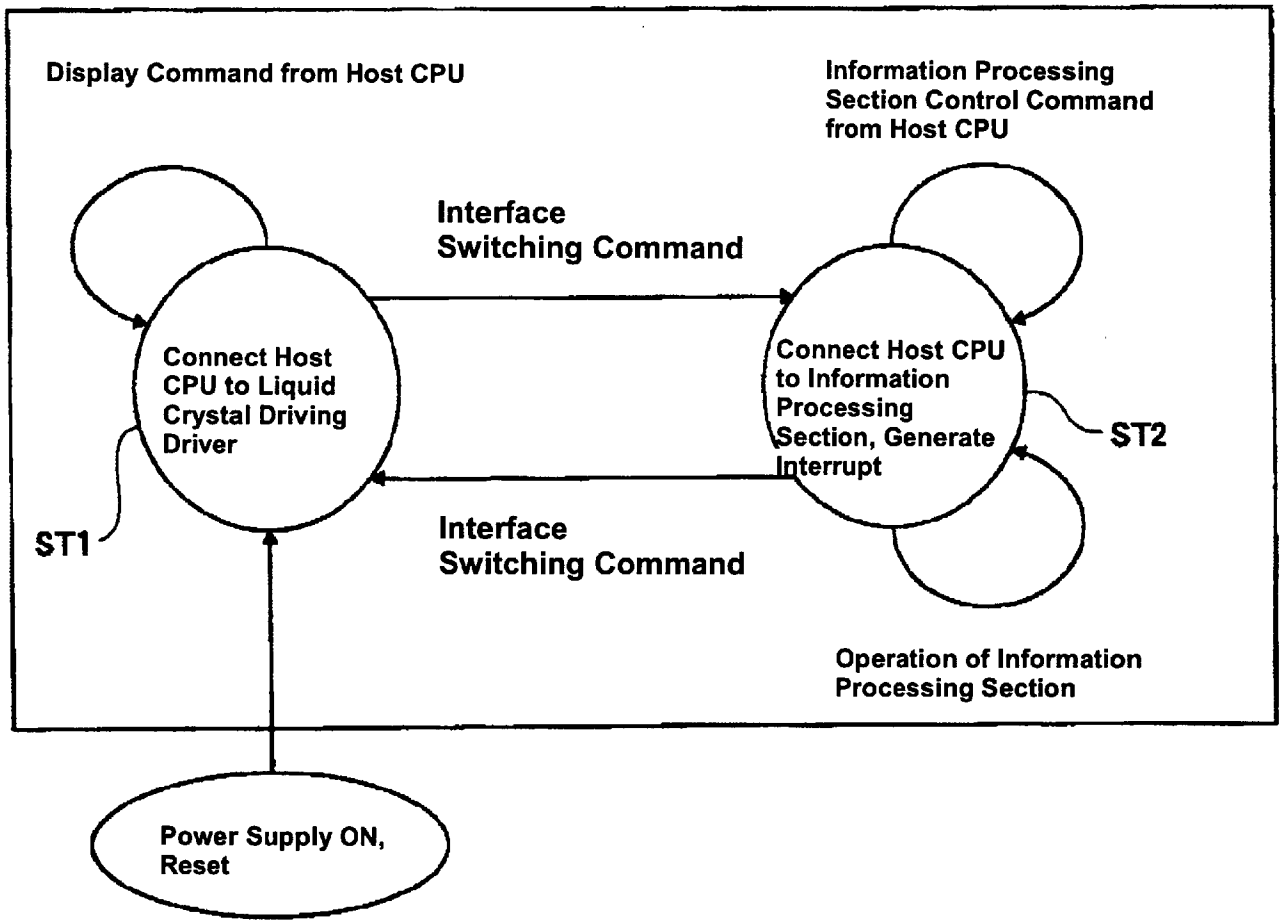
FIG. 4 shows a state shift diagram of the command interrupt logical circuit in FIG. 1.
Figure 5:
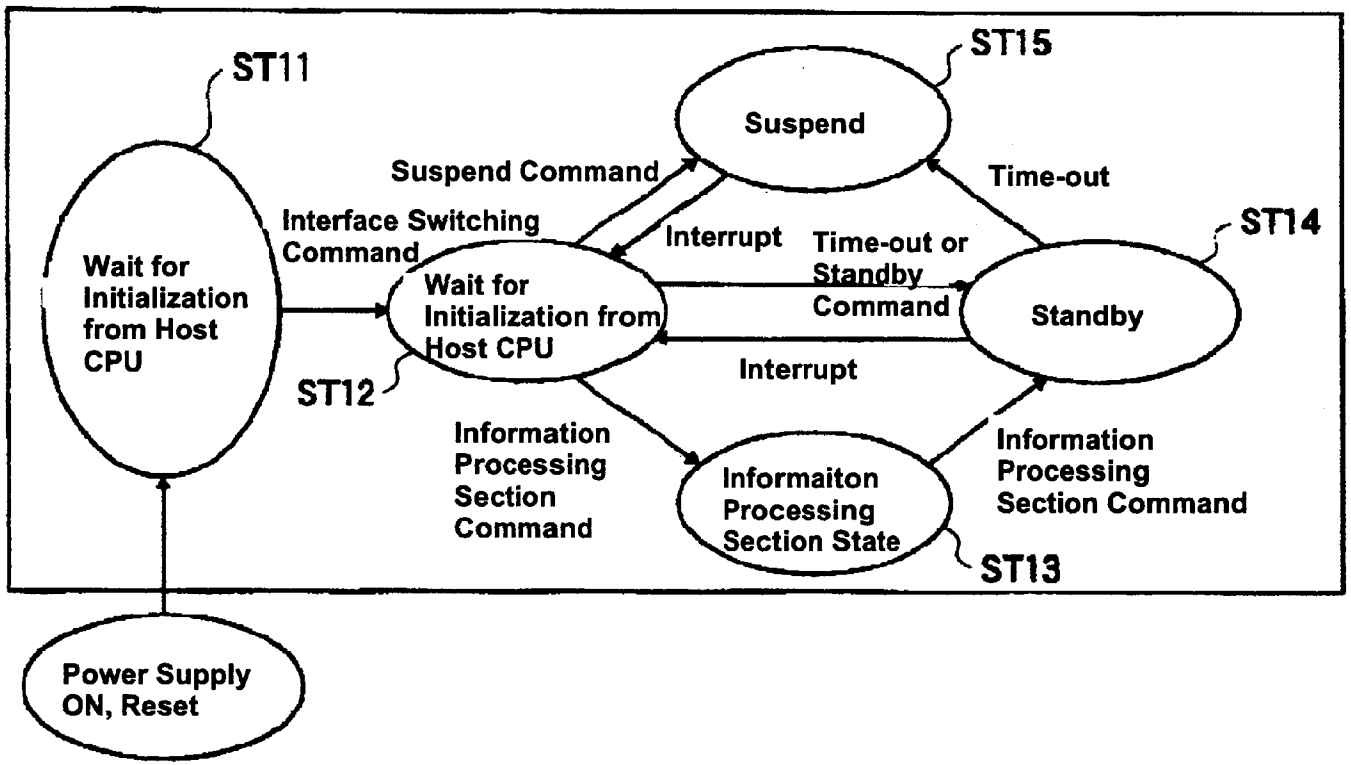
FIG. 5 shows a state shift diagram of the information processing section in FIG. 1.

Next, an operation of the mobile telephone 10 in accordance with the present embodiment will be described. FIG. 2 shows a flow chart generally illustrating a process performed by the host CPU 11. Also, FIG. 3 shows a flow chart generally illustrating a process performed by the command interrupt logical circuit 15. Further, FIG. 4 shows a diagram illustrating a state shift of the command interrupt logical circuit 15. FIG. 5 shows a diagram illustrating a state shift of the information processing section 16. An operation of the mobile telephone 10 will be described with reference to FIGS. 2 through 5.

Upon turning on the power supply or resetting, the host CPU 11 starts the process shown in FIG. 2, and the command interrupt logical circuit 15 starts the process shown in FIG. 3. Also, the command interrupt logical circuit 15 sets a state in which the host CPU 11 is connected to the driver for driving liquid crystal 17 (state ST1 in FIG. 4). Further, the information processing section 16 waits for an initialization from the host CPU 11 (state ST11 in FIG. 5), and then waits for a command from the host CPU 11 (state ST12 in FIG. 5).

When the process shown in FIG. 2 is started, in step S11, the host CPU 11 sends a command and data to the driver for driving liquid crystal 17. Next, in step S12, the host CPU 11 checks whether or not the information processing section 16 needs to be started due to reception of moving pictures or execution of the PIM. The host CPU 11 returns the process to step S11 if the information processing section 16 does not need to be operated, or otherwise advances the process to step S13. In this manner, the host CPU 11 repeats steps S11 and S12 until it becomes necessary to operate the information processing section 16 due to reception of moving pictures or execution of the PIM.

In the mean time, when the process shown in FIG. 3 starts, the command interrupt logical circuit 15 connects the host CPU 11 to the driver for driving liquid crystal 17 in step S21. Then, in step S22, the command interrupt logical circuit 15 waits to receive an interface switching command from the host CPU 11. Accordingly, the command interrupt logical circuit 15 continues the state ST1 until it receives an interface switching command from the host CPU 11. As a result, commands and data sent from the host CPU 11 in step S11 are transferred through the command and data line 103 to the driver for driving liquid crystal 17, and the driver for driving liquid crystal 17 has the liquid crystal display device 13 display characters, pictures and the like based on the commands and data. In a manner described above, the command interrupt logical circuit 15 repeats step S22 to thereby continue the state ST1 until it receives an interface switching command from the CPU 11.

In the mean time, the information processing section 16, which is waiting for a command from the host CPU 11 in the state ST12 indicated in FIG. 5, shifts to a standby state (step ST14) when it receives a standby command from the host CPU 11 or reaches a time-out, and shifts to a suspend state (state ST15) when it receives a suspend command from the host CPU 11. Also, the information processing section 16 shifts to a suspend state (state ST15) when it reaches a time-out during the suspend state (state ST14). The information processing section 16 can limit the power consumption to a low level in the standby state (state ST14) or the suspend state (state ST15). Then, the information processing section 16 waits for an interrupt command from the host CPU 11 in the state ST14 or the state ST15.

When it becomes necessary to operate the information processing section 16 due to reception of moving pictures or execution of the PIM, the host CPU 11 sends an interface switching command in step S13 indicated in FIG. 2. Then, the host CPU 11 sends commands and data to the information processing section 16 in step S14. Next, in step S15, the host CPU 11 checks whether or not the information processing section 16 should be stopped. The host CPU 11 returns the process to step S14 if the information processing section 16 does not need to be stopped, or otherwise advances the process to step S16. In this manner, the host CPU 11 repeats steps S14 and S15 until it stops the information processing section 16 due to completion of reception of moving pictures or completion of execution of the PIM.

In the mean time, the command interrupt logical circuit 15, which is waiting in step S22 indicated in FIG. 3 and continuously maintaining the state ST1 indicated in FIG. 4, shifts the process to step S23 when it receives an interface switching command. In step S23, the command interrupt logical circuit 15 starts the information processing section 16, and connects the host CPU 11 to the information processing section 16. At the same time, the command interrupt logical circuit 15 shifts from the state (state ST1) in which the host CPU 11 is connected to the driver for driving liquid crystal 17 to a state (state ST2) in which the host CPU 11 is connected to the information processing section 16. Then, in step S24, the command interrupt logical circuit 15 waits to receive an interface switching command from the host CPU 11. Accordingly, the command interrupt logical circuit 15 continues the state ST2 until it receives an interface switching command from the host CPU 11. As a result, the commands and data transmitted from the host CPU 11 in step S11 are transferred through the command and data line 110 to the information processing section 16, the information processing section 16 sends instructions based on the commands and data to the driver for driving liquid crystal 17, and the driver for driving liquid crystal 17 has the liquid crystal display device 13 display characters, images and the like based on the instructions from the information processing section 16. In this manner, the command interrupt logical circuit 15 repeats step S24 and continues the state ST2 until it receives an interface switching command from the host CPU 11.

In the mean time, the information processing section 16, which is continuing the state ST14 or the state ST15 indicated in FIG. 5, shifts to a state ST12 when it is interrupted and receives the commands and data from the host CPU 11. Then, the information processing section 16 sends to the driver for driving liquid crystal 17 instructions based on the commands and data from the host CPU 11.

When the information processing section 16 is to be stopped due to completion of reception of moving pictures or completion of execution of the PIM, the host CPU 11 transmits an interface switching command in step S16 in FIG. 2. Then, in step S11, the host CPU 11 transmits commands and data to the driver for driving liquid crystal 17. Next, in step S12, the host CPU 11 checks again whether or not the information processing section 16 needs to be started due to reception of moving pictures or execution of the PIM. The host CPU 11 returns the process to step S11 if the information processing section 16 does not need to be operated, or otherwise advances the process to step S13. In this manner, the host CPU 11 repeats steps S11 and S12 until it becomes necessary to operate the information processing section 16 due to reception of moving pictures or execution of the PIM again.

In the mean time, the command interrupt logical circuit 15, which is waiting in step S24 indicated in FIG. 3 and continuously maintaining the state ST2 indicated in FIG. 4, shifts the process to step S21 when it receives an interface switching command. In step S21, the command interrupt logical circuit 15 stops the information processing section 16, and connects the host CPU 11 to the driver for driving liquid crystal 17. At the same time, the command interrupt logical circuit 15 shifts from the state ST2 to the state ST1. Then, in step S22, the command interrupt logical circuit 15 waits to receive an interface switching command from the host CPU 11. Accordingly, the command interrupt logical circuit 15 continues the state ST1 until it receives an interface switching command from the host CPU 11. As a result, commands and data sent from the host CPU 11 in step S11 are transferred through the command and data line 103 to the driver for driving liquid crystal 17, and the driver for driving liquid crystal 17 has the liquid crystal display device 13 display characters, pictures and the like based on the commands and data from the host CPU 11. In the manner described above, the command interrupt logical circuit 15 repeats step S22 to thereby continue the state ST1 until it receives an interface switching command from the CPU 11.

In the mean time, the information processing section 16, which is sending instructions to the driver for driving liquid crystal 17 based on the commands and data from the host CPU 11 in the state ST12, shifts to a standby state (step ST14) when it receives a standby command from the host CPU 11 or reaches a time-out, and shifts to a suspend state (state ST15) when it receives a suspend command from the host CPU 11. Then, the information processing section 16 waits for an interrupt command from the host CPU 11 in the state ST14 or the state ST15.

Next, a structure of the software for the mobile telephone 10 in accordance with the present embodiment will be described.

Figure 8:
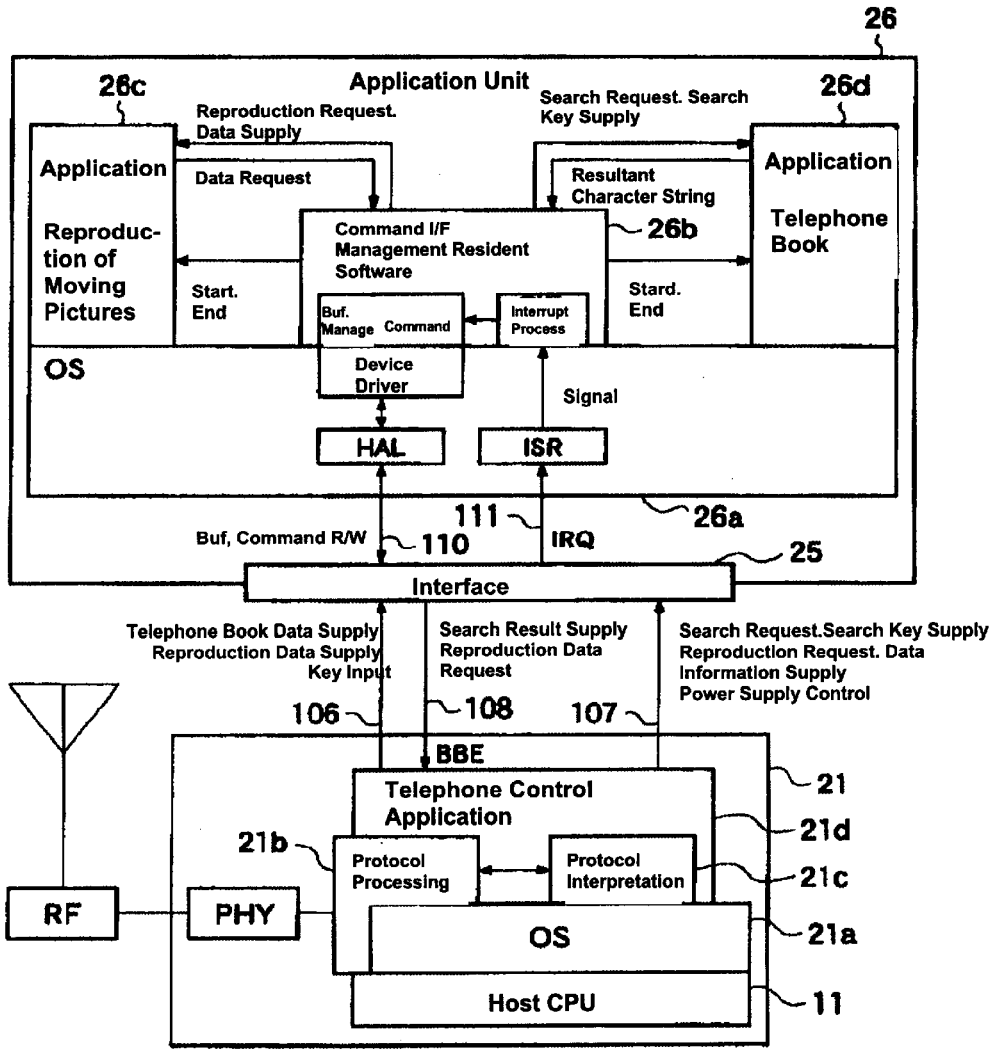
FIG. 8 shows one example of a structure of software for a mobile telephone 10 in accordance with an embodiment of the present invention.

FIG. 8 shows an example of the structure of the software for the mobile telephone 10 in accordance with the present embodiment.

FIG. 8 shows a BBE unit 21 that performs a protocol processing of the BBE (base band engine), an application unit 26 having an application processor (a high-speed operation processing apparatus such as a DSP) as a core device, and an interface (I/F) 25 that exchanges data between the BBE unit 21 and the application unit 26.

The BBE unit 21 includes the host CPU 11 that composes the mobile telephone 10 shown in FIG. 1 as a core, and an application that performs a protocol process 21*b* and a protocol interpretation 21*c* and a telephone control application 21*d* exist on an OS 21*a*.

An interface 25 corresponds to the command interrupt logical circuit 15 shown in FIG. 1, and is equipped as hardware with a buffer 153 (see FIG. 1) for exchanging data, a group of a predetermined number of registers 151 (see FIG. 1) that retain commands and data accompanying the commands, and a status resistor 152 (see FIG. 1) that indicates a state of the command interrupt logical circuit 15. The telephone control application 21*d* and the interface 25 are connected to each other by a chip select signal line 106, a signal line 107, and an interrupt request line 108. The signal lines 106 and 107 are used for telephone book data supply, reproduction data supply, key input, search request-search key supply, reproduction request-data information supply, and power supply control. The interrupt request line 108 is used to supply search results and provide interruptions for reproduction data requests and the like.

The application unit 26 is a unit that is equipped with the information processing section 16 indicated in FIG. 1. An OS 26*a* is present on the application unit 26. In the OS 26*a*, HAL (H/W Abstraction Layer: Hardware Abstraction Layer) that describes I/O addresses, interruption numbers and the like is transmitted between the interface 25 and device drivers. Also, in the OS 26*a*, an ISR (Interrupt Service Routine, or Interrupt Process Routine) receives interrupts through an interrupt request line 111, and transmits interrupt signals to a command interface (I/F) management resident software 26*b* to be described below.

On the OS 26*a* is provided the command interface management resident software 26*b* that performs a buffer management, command management and interrupt process, an application that performs, for example, reproduction of moving pictures, an application 26*d* equipped with telephone book management data, and the like.

The command interface management resident software 26*b* issues start-end instructions, and performs reproduction requests-data supplies upon receiving data requests, with respect to the application 26*c*. Also, the command interface management resident software 26*b* issues start-end instructions, performs search requests-search key supplies, and receives character strings as a result of the search, with respect to the application 26*d*.

Next, processing steps of the software described above for the mobile telephone 10 will be described.

When the BBE unit 21 receives packets, it interprets operations by the user and decides a necessary process. When the process needs processing to be conducted by the application unit 26, a command required for the process is written in the interface 25. On the side of the application unit 26, an interrupt is generated as the command is written, the application unit 26 uses the OS 26*a* to start an interrupt handler. In an ordinary multi-task OS, the interrupt handler is divided into an ISR for signaling the generation of an interrupt and a resident software (i.e., the command interface management resident software 26*b*) for performing actual processes. The command interface management resident software 26*b* is activated by the interrupt, interprets the command, starts, if required, the application on the OS 26*a* to request a necessary process. This process is, for example, an acquisition of a PIM software, transmission or reception of electronic mails, reproduction of moving pictures and the like.

Also, the BBE unit 21 side, if necessary, writes data in the data buffer 153 of the interface 25 according to a request issued from the application unit 26 side. On the application unit 26 side, an interrupt is generated again due to the writing in the buffer 153, and therefore the data is read through a buffer management module of the command interface management resident software 26*b*. The buffer management module is designed according to the structure of hardware and interface, and monitors pointers to the buffer currently in use and the size of data that are transferred or received. The application unit 26 side performs data transmission requests, provision of obtained information, and reporting of execution state of the application. Also, it follows a power supply control command from the BBE unit 21. Furthermore, for example, when a process that does not require the application unit 26 is performed, the power supply to the application unit 26 can be turned off.

As described above, by exchanging commands between the host CPU 11 of the BBE unit 21 and the high-speed operation processing apparatus of the application unit 26, an interface is achieved between the two modules. Also, by integrating interfaces into one location, the modulability can be improved, such that, when the BBE unit 21 or the application unit 26 is modified, mutual influences inflicted on them can be restrained to the minimum. Also, when the functions are expanded, such a situation can be readily accommodated by adding commands. Furthermore, by using the command interface management resident software 26*b*, high level operations that are well accommodated by the application can be performed.

Figure 6:
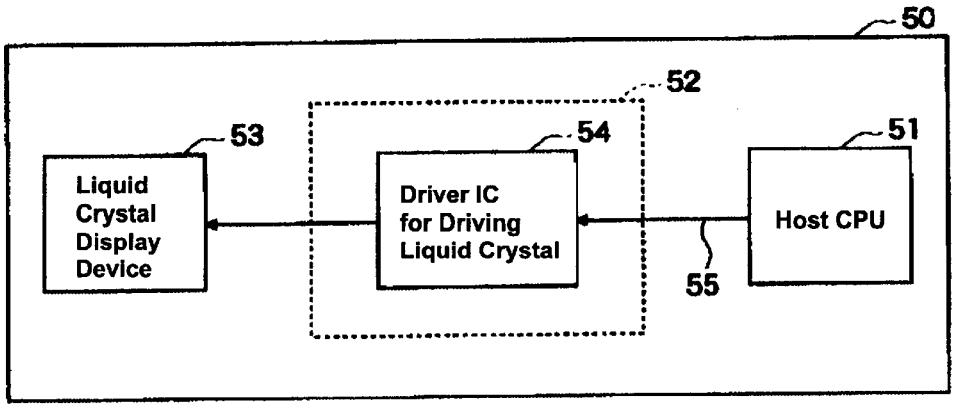
Fig. 6 (Prior Art)
FIG. 6 shows a structure in part of a conventional mobile telephone.
Figure 7:
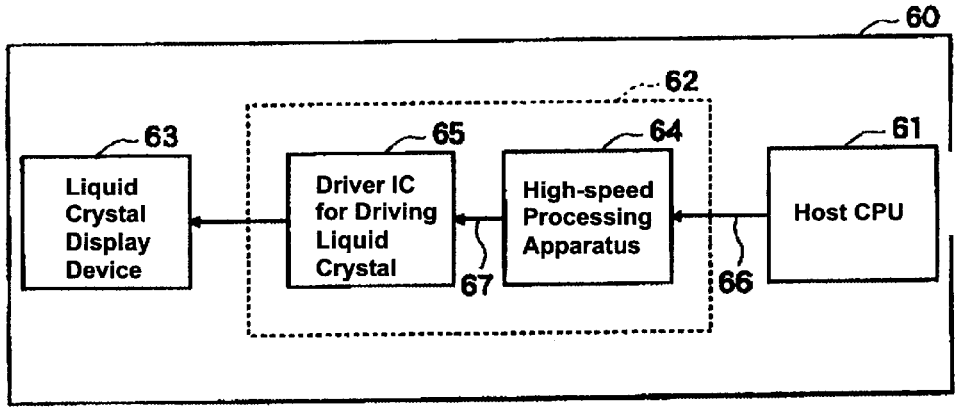
FIG. 7 shows a structure in part of a third generation mobile telephone.

As described above, by the mobile telephone 10 in accordance with the present embodiment, when it becomes necessary to operate the information processing section 16 due to reception of moving pictures or execution of the PIM, the information processing section 16 is started and the host CPU 11 is connected to the information processing section 16, and when the information processing section 16 is to be stopped due to completion of reception of moving pictures or completion of execution of the PIM, the information processing section 16 is stopped and the host CPU 11 is connected to the driver for driving liquid crystal 17. As a result, high level functions can be added while taking over the conventional host interface 55 shown in FIG. 6. Also, when moving pictures are not received or the PIM is not executed, the information processing section 16 can be placed in a standby state or a suspend state, such that the overall power consumption of the mobile telephone 10 can be reduced. Furthermore, since commands and data can be directly sent from the host CPU 11 to the driver for driving liquid crystal 17 through the command and data line 103, the field intensity, time and the like can be displayed on the liquid crystal display device 13 while maintaining the information processing section 16 in a standby state or a suspend state in cases other than reception of moving pictures and execution of the PIM. Also, the information processing section 16 can be controlled from the host CPU 11.

The above indicates an embodiment example of the information processing apparatus in accordance with the present invention. However, the present invention is also applicable to mobile information terminals (PDAs) or the like.

As described above, by an information processing apparatus in accordance with the present invention, commands from a CPU are transferred to an information processing section upon reception of moving pictures or execution of a PIM, and instructions from the CPU are transferred to a display driving device upon completion of reception of moving pictures or completion of execution of the PIM. As a result, high level functions can be added while taking over the conventional host interface. Also, by placing the information processing section in a low power consumption state when reception of moving pictures or execution of the PIM is not performed, the overall power consumption of the information processing apparatus can be reduced. Furthermore, since instructions can be directly sent from the CPU to the display driving device, the field intensity, time and the like can be displayed on a display device while maintaining the information processing section in a low power consumption state in cases other than reception of moving pictures and execution of the PIM. Also, the information processing section can be controlled from the CPU.

Also, by exchanging commands between a BBE and a resident software, an interface can be established between the two modules. Also, by integrating interfaces into one location, the modulability can be improved, such that, when the BBE or the application is modified, mutual influences inflicted on them can be restrained to the minimum. Also, when the functions are expanded, such a situation can be readily accommodated by adding commands. Furthermore, by using the resident software, high level operations that are well accommodated by the application can be performed.

The entire disclosure of Japanese Application No. 2001-215608, filed July 16, is incorporated by reference.

What is claimed is:

1. An information processing apparatus comprising:

a display device that displays at least one of characters and images;

a display driving device that drives the display device to display characters or images based on an instruction;

an information processing section that receives a command, processes the command, and sends the instruction to the display driving device;

a central processing unit that sends out the command addressed to the information processing section when a process by the information processing section is necessary, and sends out the instruction addressed to the display driving device in other cases;

a control device that transfers, upon receiving the command addressed to the information processing section, the command to the information processing section, and transfers, upon receiving the instruction addressed to the display driving device, the instruction to the display driving device; and an interface device that receives the command or the instruction from the central processing unit and transfers the same to the display driving device or the control device, wherein the information processing section is equipped with an application for reproducing moving pictures and a resident software that exchanges data with the application and manages interrupt and buffer processing of the command, the central processing unit is equipped with a base band engine, and the control device bidirectionally exchanges the command between the resident software and the base band engine.

2. An information processing apparatus according to claim 1, wherein the information processing section is adapted to take at least one of an operation state and a low power consumption state, and shifts to the low power consumption state when the command indicates shifting to the low power consumption state is received or when the command indicates shifting to the low power consumption state is not received for a specified period of time.

3. An information processing apparatus according to claim 1, wherein the information processing apparatus further comprises at least one of a mobile telephone and a mobile information terminal.

4. An information processing apparatus comprising:

a central processing unit adapted to send out a command addressed to an information processing section when a process by the information processing section is necessary, and to send out an instruction addressed to a display driving device when the process by the information processing section is not necessary;

an interface device connected to the central processing unit, a control device, and the display driving device;

the interface device being adapted to receive the command and the instruction from the central processing unit and to transfer the same to one of the display driving device and the control device;

the control device being connected to the display driving device and the information processing section;

the control device being adapted to transfer the command to the information processing section upon receiving the command addressed to the information processing section, and to transfer the instruction to the display driving device upon receiving the instruction addressed to the display driving device;

the information processing section being adapted to receive the command, process the command, and send the instruction to the display driving device; and the display driving device driving a display device based on the instruction.

5. The apparatus of claim 4 wherein the information processing section is equipped with an application for reproducing moving pictures and a resident software that exchanges data with the application and manages interrupt and buffer processing of the command.

6. The apparatus of claim 5 wherein the central processing unit is equipped with a base band engine, and the control device bidirectionally exchanges the command between the resident software and the base band engine.

7. The apparatus of claim 4, wherein the information processing section is adapted to take at least one of an operation state and a low power consumption state, and shifts to the low power consumption state when the command indicates shifting to the low power consumption state is received or when the command indicates shifting to the low power consumption state is not received for a specified period of time.

8. A method of controlling a display device comprising:

sending out a command from a central processing unit that is addressed to an information processing section when a process by the information processing section is necessary, and sending out an instruction from the central processing unit that is addressed to a display driving device in other cases;

receiving the command or the instruction from the central processing unit at an interface device and transferring the same from the interface device to the display driving device or a control device, upon receiving the command addressed to the information processing section in the control device, transferring the command from the control device to the information processing section, and, upon receiving the instruction addressed to the display driving device in the control device, transferring the instruction from the control device to the display driving device;

receiving the command in the information processing section, processing the command, and sending the instruction to the display driving device; and driving the display device to display at least one of characters and images based on the instruction.

9. The method of claim 8 wherein:

the information processing section is equipped with an application for reproducing moving pictures and a resident software that exchanges data with the application and manages interrupt and buffer processing of the command;

the central processing unit is equipped with a base band engine; and the control device bidirectionally exchanges the command between the resident software and the base band engine.

10. An information processing apparatus according to claim 8, wherein the information processing section is adapted to take at least one of an operation state and a low power consumption state, and shifts to the low power consumption state when the command indicates shifting to the low power consumption state is received or when the command indicates shifting to the low power consumption state is not received for a specified period of time.

* * * * *